United States Patent [19]

Crompton

[11] 4,173,339

[45] Nov. 6, 1979

[54] PEG GAME APPARATUS

[76] Inventor: Violet Crompton, 125 Navenby Crescent, Weston, Canada, M9L 1B3

[21] Appl. No.: 869,227

[22] Filed: Jan. 13, 1978

[51] Int. Cl.[2] ..... A63B 71/00

[52] U.S. Cl. ..... 273/95 R; 273/95 F

[58] Field of Search ..... 273/95 R, DIG. 12, 68, 273/95 F, 88

[56] References Cited

U.S. PATENT DOCUMENTS

| | | | |
|---|---|---|---|
| 128,557 | 7/1872 | Meyer | 273/68 |
| 1,187,995 | 6/1916 | Jerram et al. | 273/88 |
| 3,697,074 | 10/1972 | Duncan | 273/DIG. 12 |
| 3,792,864 | 2/1974 | Kelly | 273/95 R |
| 3,871,651 | 3/1975 | Garcia et al. | 273/95 F |
| 3,947,032 | 3/1976 | Spitzer | 273/95 F |

FOREIGN PATENT DOCUMENTS

| | | | |
|---|---|---|---|
| 847193 | 7/1970 | Canada | 273/DIG. 12 |

*Primary Examiner*—William H. Grieb

*Attorney, Agent, or Firm*—Robert D. Farkas

[57] ABSTRACT

A peg game apparatus utilizes a rectangular open-mouth container having a pair of semicircular notches midway of the length of the longest sides disposed in the marginal edges defining the mouth of the container. Spring loaded clips are located in the interior of the container along the elongated sides retaining therein a pair of pegs which may be secured to one another so as to provide a peg of length greater than that of the longest dimension of the container and a small and a short peg. The device is utilized in play wherein the short peg is "batted" about by the long peg from various positions when supported by the marginal edges of the container.

8 Claims, 6 Drawing Figures

PEG GAME APPARATUS

BACKGROUND OF THE INVENTION

1. The Field of the Invention

This invention relates to game apparatus and more specifically to that class of devices utilizing elongated pegs for striking.

2. Description of the Prior Art

The prior art abounds with game devices utilizing pegs or sticks. U.S. Pat. No. 3,947,032 issued on Mar. 30, 1976 to H. W. Spitzer teaches a recreational apparatus having plural nets, and plural scoring areas in front of each net, for use on a lawn area as small as several feet in width and approximately 40 feet in length. The "Flipper Stix" game includes a recessed and stepped starting table for receiving one of the sticks, and an elongated flipper having a handgrip portion and a flattened portion at opposite ends. Suitable clamping, staking, and tensioning apparatus are provided for sideline ropes and the nets.

U.S. Pat. No. 1,187,995 issued to L.G. Jerram, etal, teaches a baseball related game apparatus employing a projecting device suitable for projecting an elongated cylindrical peg into a target area including a simulated baseball field and scoring areas related thereto.

Each of the aforementioned Patents disclose game apparatus involving pegs in one form or another but fail to teach an inexpensive small, easily carried game device which relies virtually totally upon the skill of a user for deriving pleasure. Furthermore, the present invention represents a substantial improvement over such game devices by virtue of increasing hand dexterity and the competitive spirit of the users thereof.

SUMMARY OF THE INVENTION

A primary object of the present invention is to provide a compact, inexpensive stick game apparatus which may be carried easily from place to place, occupying a small amount of room when in a storage position and utilizing an unlimited amount of space surrounding the game when the game is employed by one or more users thereof.

Another object of the present invention is to provide a game apparatus whose components may be assembled together such that the assembled portions of the device have dimensions exceeding the game apparatus when in a storable condition.

Still another object of the present invention is to provide a game apparatus whose purpose is to increase the hand-eye coordination skills of users.

Yet another object of the present invention is to provide a game apparatus which can be easily manufactured at a low cost, yet is durable in nature and is appealing to a wide range of ages of the users thereof. Heretofore, game devices utilizing a "batting" skill of the user required substantially large and expensive devices occupying a substantial amount of space when not in use. Furthermore, such game devices relied upon tossing or manually holding the thrown or batted object without relying upon the aparatus for these functions. The present invention recognizes these problems and economically provides a game device which not only overcomes the aforementioned deficiencies but provides a device which permits the user to develop skills related to projecting elongated cylinders or pegs in twisting turning fashion after being struck by another elongated peg. The apparatus itself serves as a supporting platform from which the batted peg is projected.

These objects as well as other objects of the present invention, will become more readily apparent after reading the following description of the accompanying drawings.

DESCRIPTION OF THE PREFERRED EMBODIMENT

Figure 1:
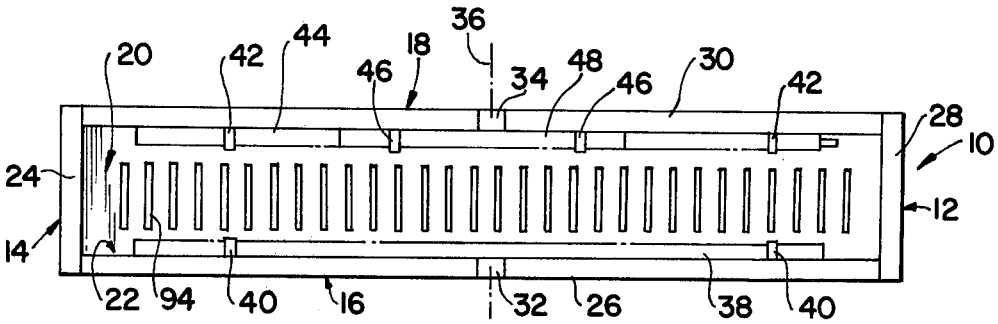
FIG. 1 is a plan view of the present invention.

The structure and method of fabrication of the present invention is applicable to an elongated rectangular box having an open-mouth portion extending along the length and width of the box such that the marginal edges of the box walls define therein a pair of semicircular notches, coaxially aligned and extending transverse to the longest dimension of the box. Such notches reside in the uppermost marginal edge of the box and have shapes, equal in size and shape, adapted to support therein a short peg having an elongated cylindrical shape. The short peg may be fabricated from wood or a rigid plastic material, such as polypropylene. The box, including its walls and base portion, may be fabricated in a unitary construction from a host of materials, preferably polypropylene. The box has typical dimensions of 12 inches wide 3 inches deep and 3 inches tall. The walls and base of the box-like container are preferably $\frac{1}{4}$ of an inch thick. The short peg-like cylinder is preferably $\frac{3}{8}$ of an inch in diameter. A pair of longer peg-like cylinders, each having a length of 9 inches preferably, are provided such that one end of one of the sticks of the pair includes a threaded portion extending outwardly from one end thereof such that the threads are coaxially aligned with the longitudinal axis of the peg carrying such threads. The threads are of a smaller outside diameter than the diameter of the body of the peg carrying same. The other peg of the pair has an equivalent length and is provided having a hole whose longitudinal axis is concentric with the longitudinal axis of the peg carrying the hole. The hole extends into one end of the peg and contains complementary threads therein, complementary to the threaded end of the other rod-like cylinder. Thus, when each longer peg or cylinder is provided having a length approximately equal to 9 inches, an 18 inch assembled peg can be fabricated by removably securing together the threaded portion of each peg. When in a disassembled state, each of the pegs is stored within the container or box, utilizing U-shaped spring loaded clips therefor fabricated to the interior lateral surfaces of the longer walls of the box. Preferably each longer peg or cylinder are stored on each longest side wall of the box. The short peg or cylinder is similarly stored above the long peg adjacent thereto on one side interior wall of the container. Each of the pegs or cylinders, when stored within the box, reside extending parallel to the lateral base of the box.

In use, the short peg is caused to reside spanning the open-mouth portion of the container, and nestled within the notches extending on the marginal edges adjacent to the open-mouth portion of the box. The longer pegs are secured together so as to form a kind of wand or bat. In one embodiment of use, the batting wand or peg is caused to have one end thereof "scooped" into the container so as to strike the short peg from a lowermost surface thereof, causing the peg to leave its resting position and fly into the air. The long peg is then utilized as a bat to strike the short peg, causing the short peg to travel in selected directions and distances away from the box or container, carried on a supporting surface. In another use, the short peg is balanced, partially hanging off from the exterior surface of the container by having a portion of the short peg extend over the open-mouth portion of the box. In such a resting position, the short peg is struck by the batting peg or wand, so as to cause the short peg to fly upwardly and outwardly from the open-mouth portion of the container. The elongated peg is then utilized as a bat so as to project the small peg outwardly from the area occupied by the box. In similar fashion, the box or container may be utilized to provide supporting surfaces for the short peg, such as by inverting the box, turning the box on its side, or causing the box to rest upon a short side thereof extending upwardly from a supporting surface.

Now referring to the figures, and more particularly to the embodiment illustrated in FIG. 1 showing a boxlike container having short side walls 12 and 14 and elongated walls 16 and 18, located so as to define a rectangular enclosure. The interior of the box 20 is defined by an open-mouth portion 22 extending inbetween marginal edges 24, 26, 28, and 30, each being formed by side walls 14, 16, 12, and 18 respectively. Groove 32 is shown located in marginal edge 26 and is coaxially aligned with groove 34, located in marginal edge 30. Groove 32 and 34 extend along dotted line 36 which is parallel to walls 12 and 14 and perpendicular to walls 16 and 18. Elongated rod-like element 38 is shown stored within cavity 20 and retained secured to wall 16, utilizing U-shaped spring biased clips 40 therefor. Such clips are permanently fastened to wall 16 and are configured to retain cylinder 38 therein securely. Clips 42, similar in construction to clips 40 provide securing means for cylinder 44. Clips 46, similar in construction to clips 40 provide support for peg-like cylinder 48. Cylinders 48 and 44 are shown secured to the internal surface of wall 18. Grooves 94 as shown, are included on the uppermost surface of the base of box 20.

Figure 2:
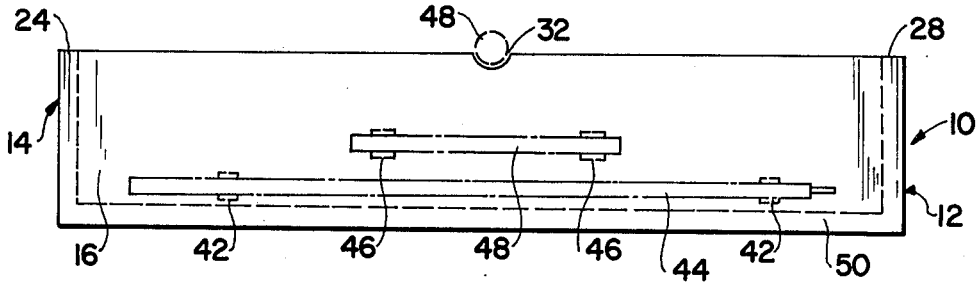
FIG. 2 is a side elevation view of the present invention.

FIG. 2 illustrates box 10 having a base portion 50 secured to walls 16, 14, and 12. Base 50, is also secured to wall 18 shown in FIG. 1. Groove 32 is provided having a semicircular shape adapted to provide support for peg 48, shown in dotted lines, residing therein. Cylinders 44 and 48 are shown secured to wall 18, disposed behind wall 16, utilizing clips 42 and 46 therefor.

Figure 3:
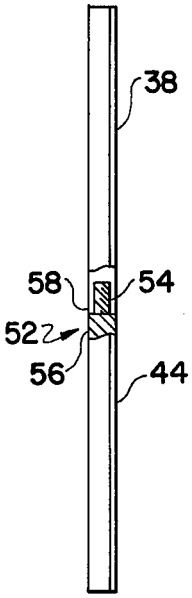
FIG. 3 is an assembled view of the elongated peg pair of the present invention.

FIG. 3 illustrates cylinders 38 and 44 secured together so as to comprise an elongated cylinder 52 thereby. Cylinder 44 is provided having a threaded surface 54 located adjacent end 56 thereof. End 58, of cylinder 38, is provided with an opening complementarily threaded to threads 54, shown on cylinder 44. Elongated assembled cylinder 52, is provided having a length substantially equivalent to twice the length of cylinders 38 and 44.

Figure 4:
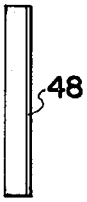
FIG. 4 is a side elevation view of the short peg utilized in the present invention.

FIG. 4 illustrate cylindrical rod 48, serving as a peg-like device suitably constructed for striking by assembled cylinder 52, shown in FIG. 3.

Figure 5:
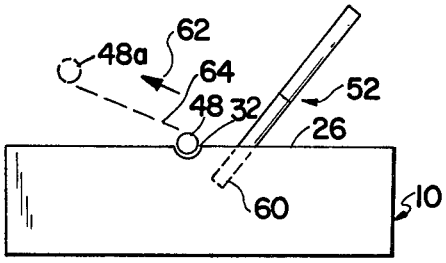
FIG. 5 is a side elevation view of one use of the components of the present invention.

FIG. 5 illustrates box 10 having peg 48 shown residing at 32. Assembled cylinder 52 is shown having end 60 partially contained within box 10. When end 60 is moved rapidly in the direction of arrow 62, peg 48 is projected along a path depicted by dotted line 64 so as to eventually occupy a position shown by dotted lines **48*a***.

Figure 6:
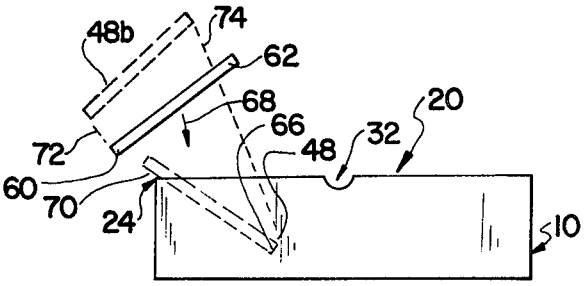
FIG. 6 is an alternate use of the devices shown in FIG. 5.

FIG. 6 illustrates box 10 having peg 48 balance on marginal edge 24 thereof. End 66 of peg 48 is shown residing partially over openmouth portion 20 of box 10. When assembled cylinder 52 is caused to have end 60 thereof move rapidly in direction of arrow 68, end 60 strikes peg 48 at point 70. Peg 48 is caused to travel along dotted lines 72 and 74 so as to eventually reside in a position shown by dotted line **48*b***.

One of the advantages of the present invention is to provide a compact, inexpensive stick game apparatus which may be carried easily from place to place, occupying a small amount of room when in a storage position and utilizing an unlimited amount of space surrounding the game when in a storable condition.

Another advantage of the present invention is to provide a game apparatus whose components may be assembled together such that the assembled portions of the device have dimensions exceeding the game apparatus when in a storable condition.

Still another advantage of the present invention is to provide a game apparatus whose purpose is to increase the hand-eye coordination skills of users.

Yet another advantage of the present invention is to provide a game apparatus which can be easily manufactured at a low cost, yet is durable in nature and is appealing to a wide range of ages of the users thereof.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention is which an exclusive privilege or property is claimed are defined as follows:

1. A peg game apparatus comprising a box, said box having side walls and a base, said side walls defining an open-mouth portion of said box and an interior portion of said box, a pair of notches, each of said pair of notches extending into said open-mouth portion of said box, said pair of notches aligned and disposed opposite each other, a first rod, a second rod, a third rod, means to removably secure said first rod and said second rod and said third rod within said box, said means to removably secure including a plurality of U-shaped clips, each of said U-shaped clips having a pair of free ends, said pair of free ends being biased towards each other, said U-shaped clips being secured to said side walls, one end of said second rod having a first plurality of threads located on an exterior surface thereof, one end of said third rod having a hole, said hole having the longitudinal axis thereof disposed coaxially aligned with the longitudinal axis of said third rod, a second plurality of threads located within said hole and complementary shaped to said first plurality of threads, said first rod having a shorter length than said second and said third rods, said box being configured to entirely contain said first and said second and said third rods within said interior portion of said box when said first and said second and said third rods are secured to said means to removably secure, said notches being a distance apart less than the length of said first rod, whereby said second rod and said third rod are removably secured to one another utilizing said first and said second plurality of threads therefor and whereby said second and said third rods when removably secured together define an elongated rod having a length greater than the largest dimension of said box.

2. The apparatus as claimed in claim 1 wherein each of said notches have a semicircular shape.

3. The apparatus as claimed in claim 1 wherein said second rod and said third rod have substantially the same length.

4. The apparatus as claimed in claim 1 wherein said box is a unitary construction.

5. The apparatus as claimed in claim 1 wherein said box comprises polypropylene.

6. The apparatus as claimed in claim 1 wherein said second rod and said third rod comprise polypropylene.

7. The apparatus as claimed in claim 1 wherein said first rod comprises wood.

8. The apparatus as claimed in claim 1 wherein the longitudinal axes of said second and said third rod are coaxially aligned when said second and said third rods are removably secured to one another.

* * * * *